US008272523B1

(12) United States Patent
DeMusis, Sr.

(10) Patent No.: US 8,272,523 B1
(45) Date of Patent: Sep. 25, 2012

(54) HOLDER FOR POLISH CONTAINERS

(75) Inventor: Richard P. DeMusis, Sr., Northford, CT (US)

(73) Assignee: Shine Mate LLC, Northford, CT (US)

( * ) Notice: Subject to any disclaimer, the term of this patent is extended or adjusted under 35 U.S.C. 154(b) by 223 days.

(21) Appl. No.: 12/627,024

(22) Filed: Nov. 30, 2009

Related U.S. Application Data

(63) Continuation-in-part of application No. 12/113,463, filed on May 1, 2008.

(51) Int. Cl.
*B65D 23/12* (2006.01)

(52) U.S. Cl. ..... 215/393; 248/346.04; 220/737

(58) Field of Classification Search ..... 220/737, 220/23.9, 23.91; 248/346.04, 362; 215/393; 47/39

See application file for complete search history.

(56) References Cited

U.S. PATENT DOCUMENTS

| | | | | |
|---|---|---|---|---|
| 2,963,256 | A | | 12/1960 | Borah |
| 2,968,888 | A | | 1/1961 | Borah |
| 4,998,696 | A | | 3/1991 | Desjardins |
| 5,088,673 | A | * | 2/1992 | Chandler ..... 248/311.2 |
| 5,174,534 | A | * | 12/1992 | Mitchell ..... 248/311.2 |
| D351,970 | S | | 11/1994 | Barrio |
| 5,984,156 | A | * | 11/1999 | Bridges ..... 224/566 |
| 6,116,455 | A | * | 9/2000 | Rossman et al. ..... 220/575 |
| 6,543,637 | B1 | * | 4/2003 | Osborn ..... 220/737 |
| 6,571,976 | B1 | | 6/2003 | Sonnabend |
| 6,596,374 | B1 | | 7/2003 | Adjeleian |
| D516,872 | S | | 3/2006 | Rigberg et al. |
| 2007/0012706 | A1 | | 1/2007 | Deadman |

* cited by examiner

*Primary Examiner* — Anthony Stashick
*Assistant Examiner* — Jeffrey Allen
(74) *Attorney, Agent, or Firm* — DeLio & Peterson, LLC; Thomas E. Ciesco

(57) ABSTRACT

A holder for circular containers of polish, waxes, pastes and liquids comprising a generally circular base having an underside surface cupped downward and a hollowed circular aperture having an aperture bottom and at least one vertical aperture wall adapted to frictionally accept a container. The holder includes an adapter ring having an outer diameter corresponding to the at least one vertical aperture wall and an inside diameter adapted to frictionally support the container. The downward cupped underside surface is adapted to create a vacuum adhesion to a support surface upon which it is placed when a downward pressure is applied to the holder.

2 Claims, 5 Drawing Sheets

HOLDER FOR POLISH CONTAINERS

This application is a continuation-in-part of U.S. Ser. No. 12/113,463 filed on May 1, 2008.

BACKGROUND OF THE INVENTION

1. Field of the Invention

The present invention relates to a holder for various sized containers of polish, waxes, pastes and liquids used for metal, wood, or shoe maintenance.

2. Description of Related Art

Applying a polish, wax or other paste during metal, wood, or shoe maintenance is a common occurrence for individuals who prefer to maintain their flatware, furniture, and shoes looking shiny and clean while keeping their hands and clothes free from the paste being applied to these items. Especially for a person who performs these maintenance tasks for a living, an aid for expediting the task or in making the task easier is always appreciated.

Using shoe maintenance as an example, in applying a paste to a shoe, a person must hold the paste container in one hand, the applicator in the other hand, and then contact the applicator with the paste until a small amount of paste adheres to the applicator. The person must then place the can on a surface to free that hand so a shoe can be held in that hand. Paste that is on the applicator is then applied onto the shoe and rubbed into the shoe surface. If additional paste is needed, the person must release the shoe, pick up the can, and repeat the step of acquiring paste onto the applicator. Again the person must release the can, pick up the shoe, and apply the paste to the shoe. This repeated action is necessary because the container of polish needs to be secure when applying horizontal pressure to the paste container in acquiring the paste onto the applicator. Paste containers are usually smooth on the bottom surface and will slide across a table, ground, or wherever the can is placed when a horizontal pressure is applied.

In art related to holders in general, there are several adapted with a cupped bottom for suction to non-porous surfaces. One problem with these is that although they may adhere well to a non-porous surface, they have no capacity to prevent sliding on a porous surface such as a carpet, concrete floor, or tablecloth. Also the holders are limited to holding containers only as small as their innermost aperture. In attempting to hold a container that is too small, the container is not properly held and any pressure applied to the container will tip or slide the container out of the holder.

SUMMARY OF THE INVENTION

Bearing in mind the problems and deficiencies of the prior art, it is therefore an object of the present invention to provide a holder for various sized containers of polish, waxes, pastes and liquids.

It is another object of the present invention to provide a holder for various sized containers of polish, waxes, pastes and liquids which will provide resistance to sliding on porous and non-porous surfaces.

A further object of the present invention is to provide a holder for various sized containers of polish, waxes, pastes and liquids which is versatile in the container configurations which are acceptable to the aperture of the holder.

It is yet another object of the present invention to provide a method for using a holder for various sized containers of polish, waxes, pastes and liquids used for metal, wood, and shoe maintenance.

It is still another object of the present invention to provide a holder for containers of polish, waxes, pastes and liquids which includes an adapter ring for securing various sized containers.

Still other objects and advantages of the invention will in part be obvious and will in part be apparent from the specification.

The above and other objects, which will be apparent to those skilled in the art, are achieved in the present invention which is directed to a holder for containers of polish, waxes, pastes and liquids comprising a generally circular base having an underside surface cupped downward and a hollowed circular aperture having an aperture bottom and a vertical aperture wall adapted to frictionally accept a paste container. The holder includes a first adapter ring having an outer diameter corresponding to the vertical aperture wall and an inside diameter adapted to frictionally support a first small paste container. The holder is flexibly elastomeric having a tackiness sufficient to prevent the holder from sliding across a support surface upon which it is placed. The downward-cupped underside surface of the holder is adapted to create a vacuum adhesion to a support surface upon which it is placed when a downward pressure is applied to the holder. The hollowed circular aperture may be referred to as a circular recess.

In another aspect of the invention, the holder may include at least one additional vertical wall concentrically spaced such that the holder frictionally accepts various sized paste containers. The hollowed circular aperture may include concentric ridges in the wall of the aperture for creating a plurality of seats for engaging paste containers of various sizes.

The aperture bottom of the holder has a depressed ring adapted to fit the bottom surface of a container having a ring protruding downward. Alternately, the aperture bottom of the holder may be substantially flat.

In an alternate embodiment of the invention, the holder includes at least one additional adapter ring interchangeable with the first adapter ring for frictionally supporting a second small paste container sized differently than the first small paste container.

In another embodiment, the present invention is a holder for circular containers of polish, waxes, pastes and liquids comprising a generally circular base having an underside surface cupped downward and a circular recess having a vertical recess wall. The holder includes an adapter ring having an outside diameter sized to frictionally accept the vertical recess wall and an inside diameter sized for holding a container. The downward cupped underside surface is adapted to create a vacuum adhesion to a support surface upon which it is placed when a downward pressure is applied to the holder. The circular recess may include at least one additional vertical wall concentrically spaced with the vertical recess wall such that the holder frictionally accepts a container in the vertical recess wall or the at least one additional vertical wall. The hollowed circular recess includes at least one ridge for engaging a bottom portion of a container. The holder includes a notch in a portion of the ridge for accommodating a key disposed on the vertical wall of a container. The recess bottom may include a circular groove adapted to fit the bottom surface of a container having a ring protruding downward. The adapter ring may include a downwardly protruding ring engagable with the circular groove on the recess bottom. The holder may include at least one additional adapter ring interchangeable with the first adapter ring for frictionally supporting a container.

A preferred embodiment of the present invention is a holder for circular containers of polish, waxes, pastes and liquids comprising a generally circular base having an underside surface cupped downward and a hollowed circular aperture having an aperture bottom and at least one vertical aperture wall adapted to frictionally accept a container. The preferred embodiment includes an adapter ring having an outer diameter corresponding to the at least one vertical aperture wall and an inside diameter adapted to frictionally support the container and an inwardly protruding lip along a bottom portion of the inside diameter for supporting the bottom of the container. The downward cupped underside surface is adapted to create a vacuum adhesion to a support surface upon which it is placed when a downward pressure is applied to the holder.

In the preferred embodiment of the holder, the circular aperture includes at least one additional vertical wall concentrically spaced with the at least one vertical aperture wall such that the holder frictionally accepts various sized containers. The circular aperture may include at least one ridge for engaging a bottom portion of a container. The holder may include a notch in a portion of the ridge for accommodating a key disposed on the vertical wall of a container. The aperture bottom may include a circular groove adapted to fit the bottom surface of a container having a ring protruding downward. The adapter ring may include a downwardly protruding ring engagable with the circular groove on the aperture bottom. The key disposed on the vertical wall of a container may be a rotatable key having wings for grasping. A key is commonly disposed on the side of a shoe polish container.

The holder may include at least one additional adapter ring interchangeable with the first adapter ring for frictionally supporting a container.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENTS

In describing the preferred embodiment of the present invention, reference will be made herein to FIGS. 1-12 of the drawings in which like numerals refer to like features of the invention.

Figure 1:
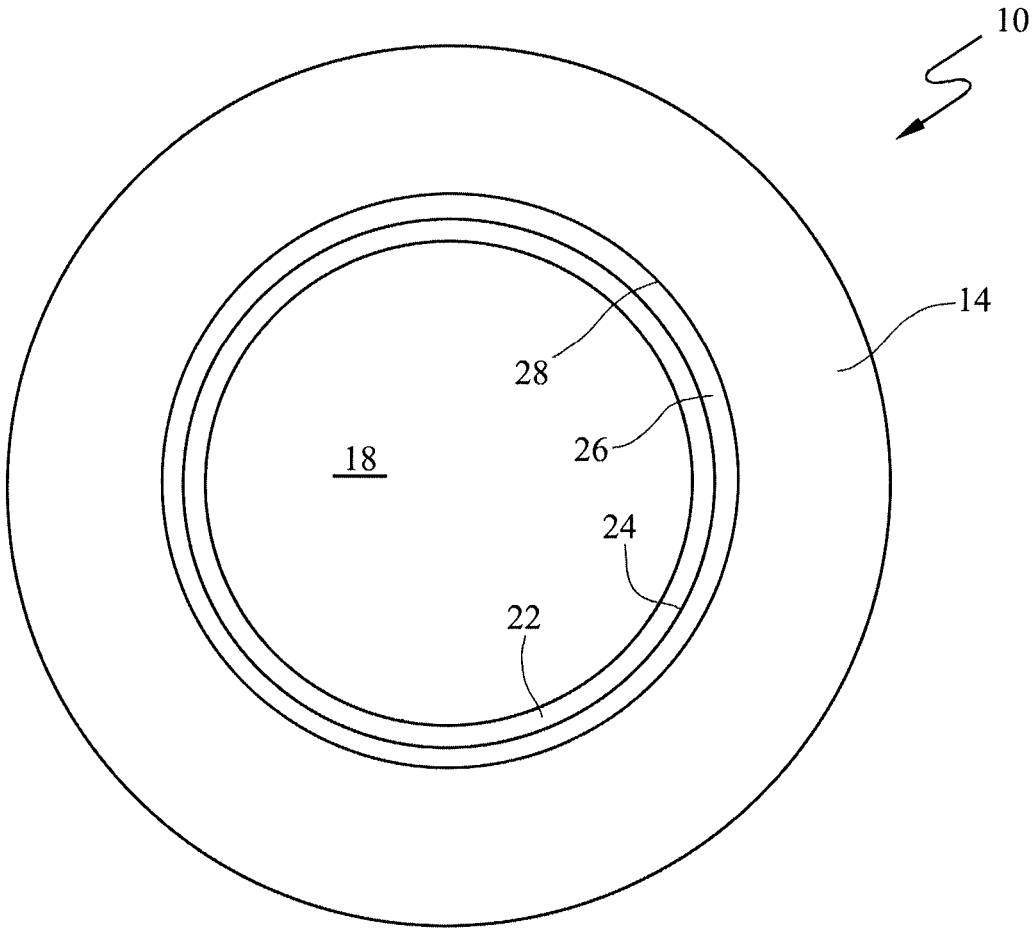
FIG. 1 is a top plan view of the holder of the present invention
Figure 2:
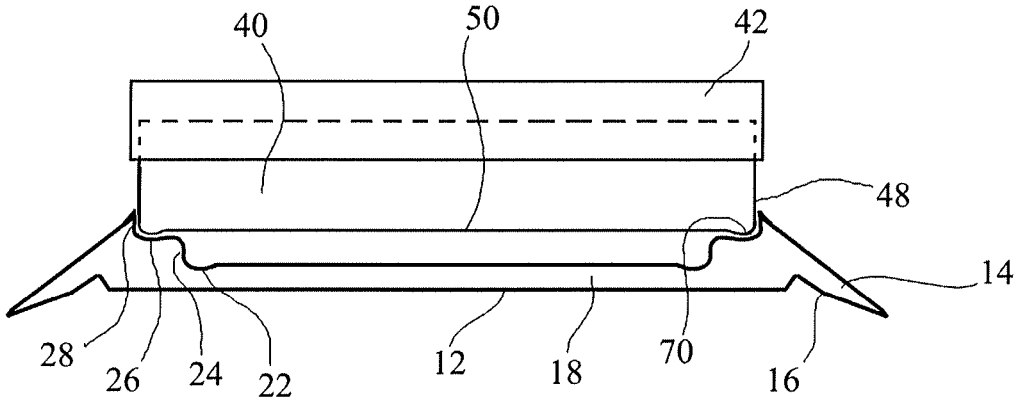
FIG. 2 is a side elevational view of the holder of the present invention securing a large polish container.
Figure 3:
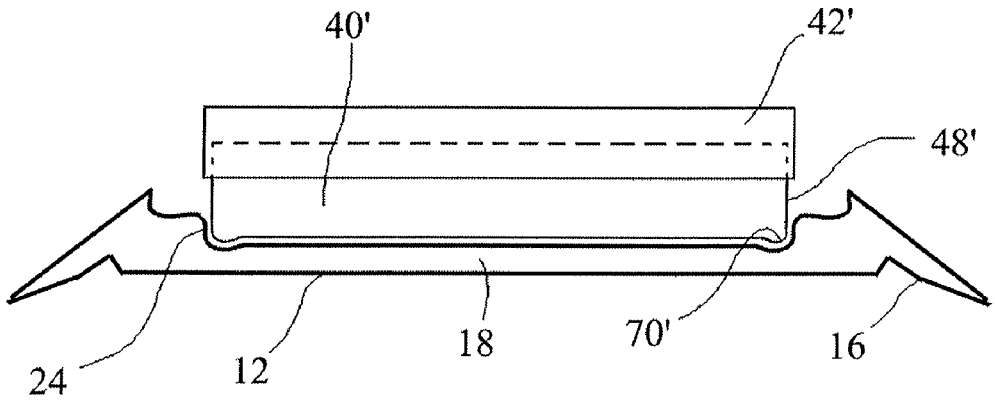
FIG. 3 is a side elevational view of the holder of the present invention securing a medium sized polish container.

FIGS. 1-3 show a holder 10 for containers 40, 40' of polish, waxes, pastes and liquids used for metal, wood, or shoe maintenance. The holder includes a generally circular base 14 having an underside surface 16 cupped downward to create a vacuum adhesion to a support surface upon which it is placed when a downward pressure is applied to the holder. The support surface is generally any surface which the holder may be placed upon such as a table, chair, or floor.

The holder 10 includes a hollowed circular aperture having an aperture bottom 18 and a first vertical aperture wall 28 adapted to frictionally accept a first paste container 40. A portion of the container bottom 50 contacts a horizontal seat 26 of the holder 10.

The hollowed circular aperture of the holder includes at least one additional vertical wall 24 concentrically inward the first vertical wall 28 for accepting a second paste container 40' smaller than the first paste container 40. Additional vertical walls or steps may be included for accepting other sized containers.

FIG. 2 shows the holder as it would be used for a first container 40 having an outer diameter 48 sized to fit snugly within aperture created by vertical wall 28 of the holder. The bottom 50 of the first container may have a portion thereof spaced above the upper surface of the holder bottom. In other words the container bottom 50 will not be in complete contact with the aperture bottom 18.

FIG. 3 shows the holder as it would be used for a second container 40' having an outer diameter 48' sized to fit snugly within the aperture created by vertical wall 24 of the holder. In this position the bottom of container 40' would be in substantially complete contact with the aperture bottom 18.

Figure 4:
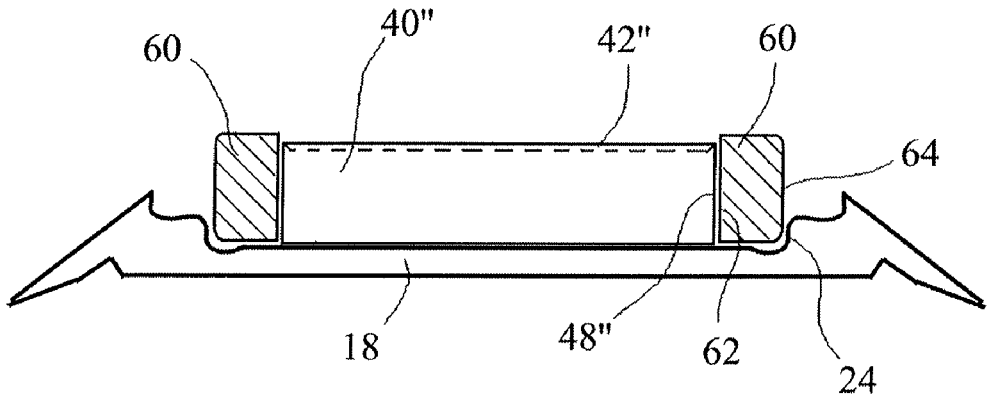
FIG. 4 is a side elevational view of the holder of the present invention using an adapter ring to secure a small polish container.
Figure 5:
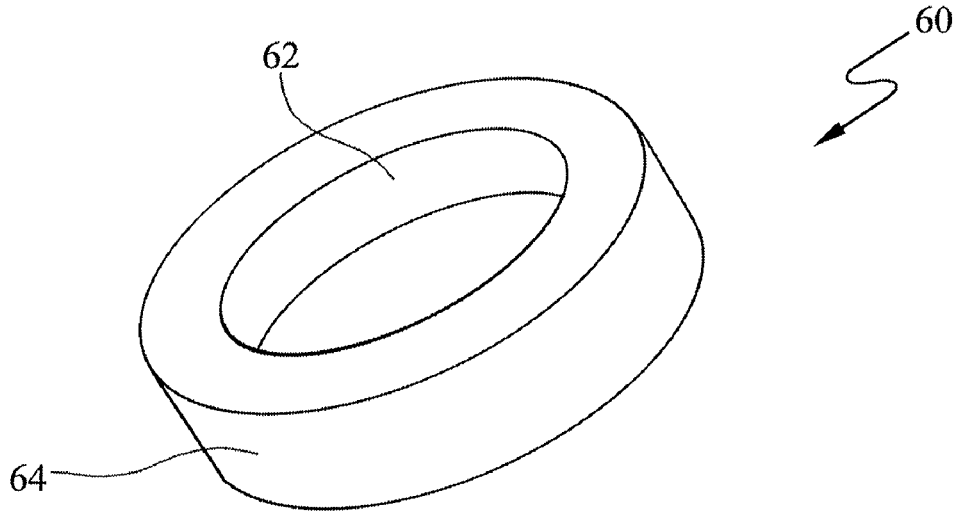
FIG. 5 is a perspective view of the adapter ring of the present invention.

As shown in FIG. 4, the holder of the present invention also includes an adapter ring 60 for fitting a smallest paste container 40" having an outer diameter 48" which is too small to frictionally fit the innermost aperture 24 of the holder. FIG. 5 shows the adapter ring 60 which includes an outer perimeter 64 which frictionally contacts the vertical wall 24 of the holder and an inner perimeter 62 which frictionally contacts the smallest paste container 40". In an alternate embodiment of the invention, the holder includes at least one additional adapter ring interchangeable with the first adapter ring for frictionally supporting a second small paste container sized differently than the smallest paste container.

Figure 6:
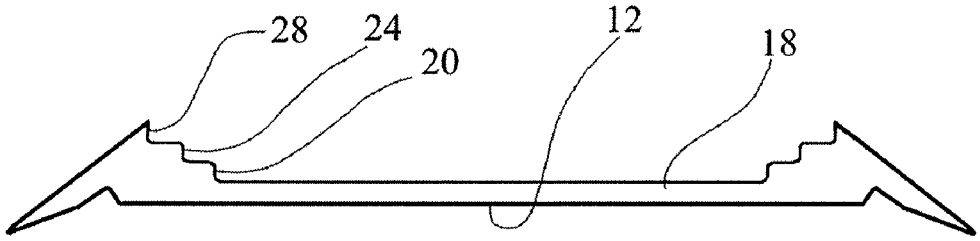
FIG. 6 is a side elevational view of a second embodiment of the present invention.
Figure 7:
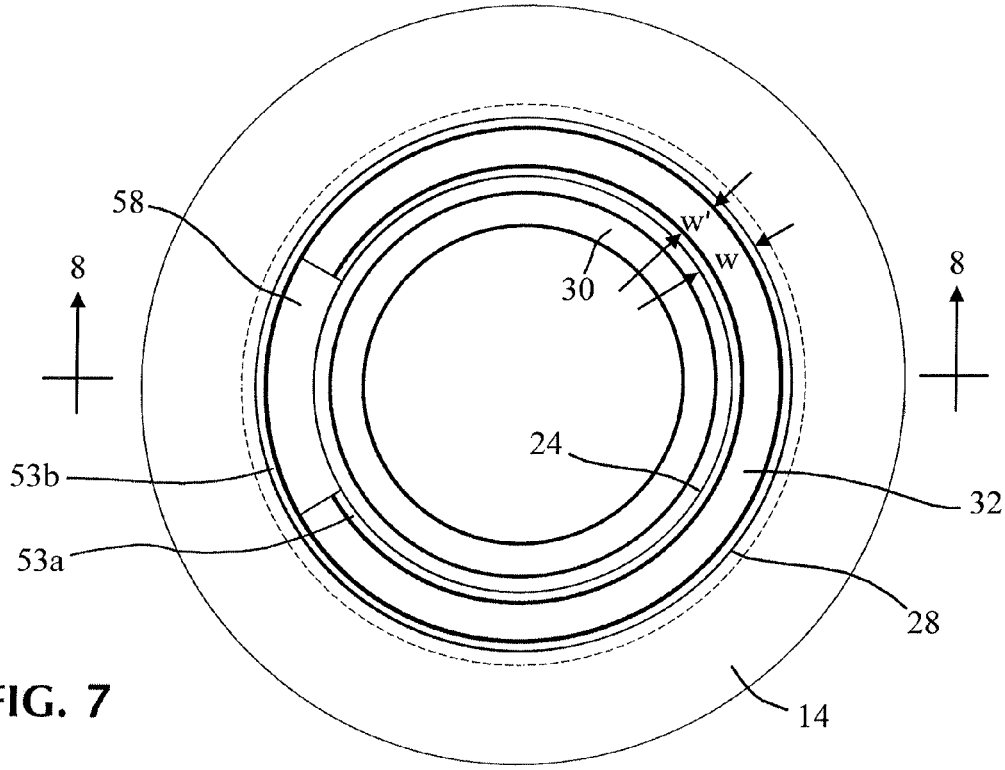
FIG. 7 is a top plan view of a preferred embodiment of the holder according to the present invention.

The holder of the present invention may include additional concentric vertical walls adapted to hold a larger variety of paste containers. As shown in FIG. 6, the holder may include three concentric vertical walls 20, 24, 28, which will, when optionally incorporating the adapter ring 60, accept four sizes of paste containers. In this same approach of adding steps to the aperture of the holder, the holder may include as many steps or concentric vertical walls as is needed for a desired number of paste container sizes.

The containers of paste 40, 40', 40" are generally supplied with cover 42, 42', 42" respectively, for preventing the paste from drying out during periods of non-use.

The holder 10 is molded from a flexible elastomeric material having a tackiness sufficient to prevent the holder from sliding across a porous or nonporous surface upon which it is placed. Moreover, when a downward force is applied sufficient to flex the underside surface 16, the air is pushed out from under the bottom 12 of the holder. When the downward force is released and the surface is nonporous and flat, the tension created by the absence of air secures the underside surface 16 much like a suction cup. This coupled with the tackiness provide for a more secure attachment to the surface.

The aperture bottom 18 of the holder may be substantially flat. Alternately, the aperture bottom 18 of the holder may include a depressed ring 22 adapted to fit the bottom surface of a container having at least one ring 70, 70' protruding downward from the container bottom surface.

Figure 8:
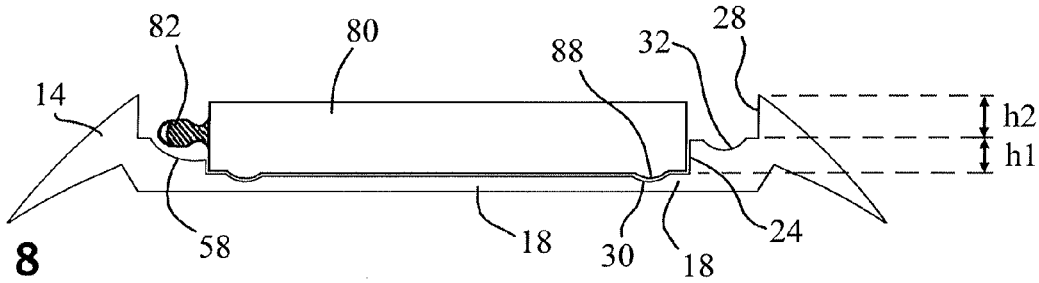
FIG. 8 is a cutaway view of the holder in FIG. 7 across the cut lines 8-8 securing a container.
Figure 9:
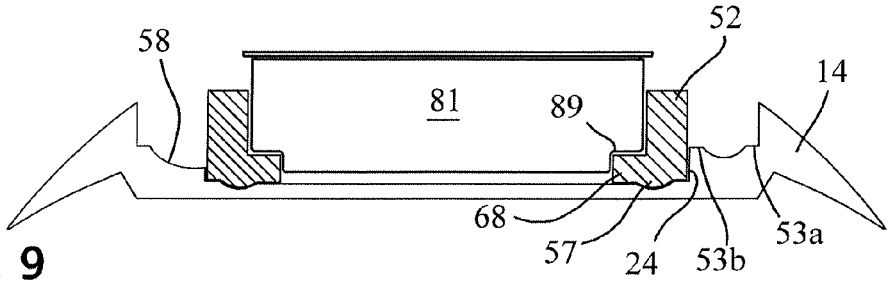
FIG. 9 is a cutaway view of the holder in FIG. 7 across the cut lines 8-8 securing the adapter ring and a container.
Figure 10:
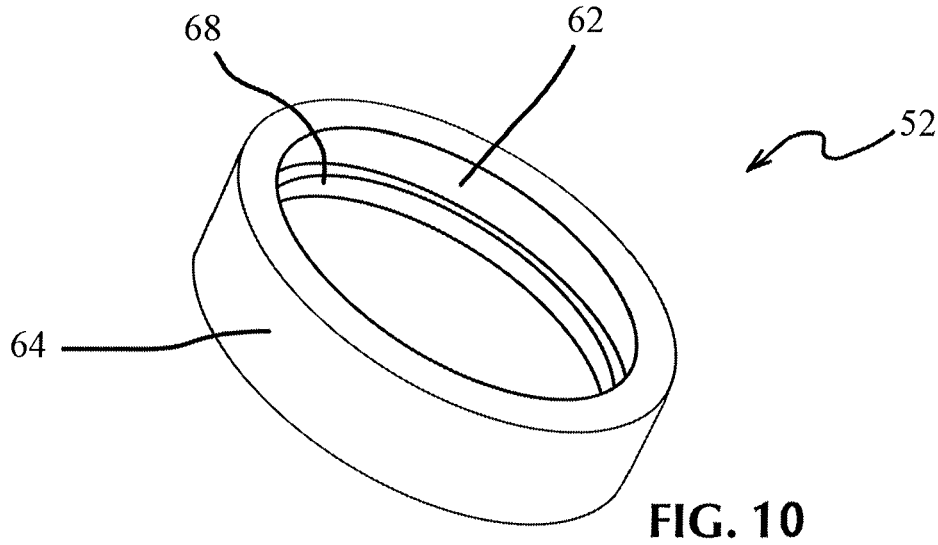
FIG. 10 is a perspective view of the preferred adapter ring according to the present invention.
Figure 11:
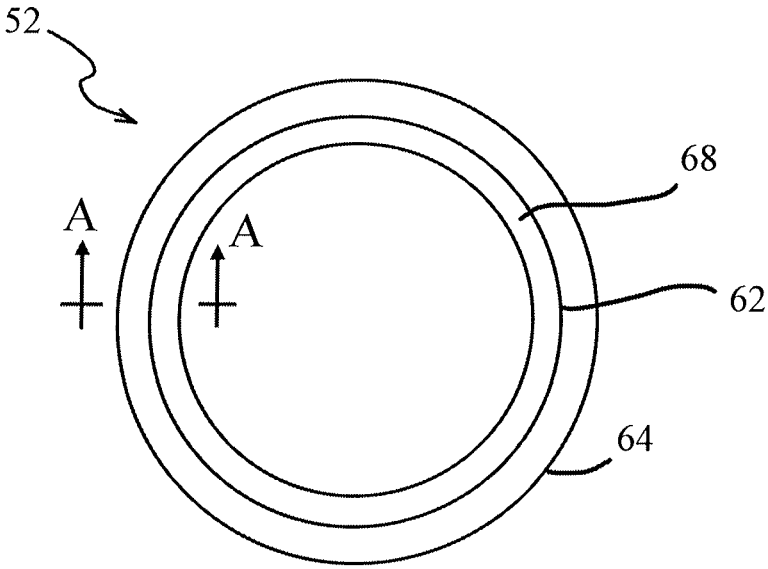
FIG. 11 is a top plan view of the preferred adapter ring according to the present invention.

The preferred embodiment of the present invention is shown in FIGS. 7-12. The holder includes a generally circular base 14 shown in a top view of FIG. 7 with an underside surface cupped downward and a hollowed circular aperture having an aperture bottom 18. FIG. 8 is a cross sectional view of the holder of FIG. 7 and includes a container 80 which may be placed in the holder. The aperture includes an outer vertical wall 28 extending a height h2 from a circular ridge 53*a*, 53*b* to the top of the base 14. The aperture includes an inner vertical aperture wall 24 extending a height h1 from the aperture bottom to the ridge 53. The ridge may include a groove 32 and the aperture bottom may include a depressed ring 30. The ridge 53 includes a notch 58 for accommodating a container key 82 attached to a container 80 shown in FIG. 8. The depressed ring 30 is adapted to accommodate a protruding bottom ring 88 of a container 80. The depressed ring 30 is adapted to alternately accommodate a downward projection 57 of an adapter ring 52 as shown in FIG. 9. The groove 32 is adapted to accommodate the ring 70 of a container 40 as shown in FIG. 2.

Figure 12:
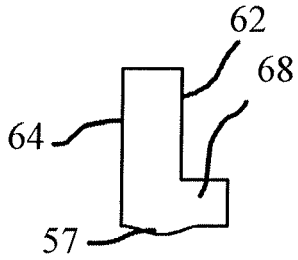
FIG. 12 is a cutaway view of the preferred adapter ring of FIG. 11 across the cut lines A-A.

The preferred embodiment of the holder includes an adapter ring 52 shown in FIGS. 9-12. FIG. 12 is a cutaway view of the adapter ring in FIG. 11 along the cut lines A-A. The adapter ring has an outer perimeter 64 which sealingly contacts the inner vertical aperture wall 24. The adapter ring includes and an inside perimeter 62 adapted to frictionally support a container 81. The adapter ring 52 includes an inwardly protruding lip 68 along a bottom portion of the inside perimeter 62 for supporting the bottom of the container 81. The lip 68 provides support for containers having an inward bottom crease such as the crease 89 on container 81.

One feature of the present container includes the ability for the base to securely attach to a table surface when a container is in the holder and to easily detach when the container is removed from the holder. The holder, including the aperture bottom is made from an elastomeric material, allowing the bottom to flex like a diaphragm. This allows the vacuum force from the holder aperture and container to be transferred to the holder underside. When the container is removed, the holder bottom collapses and the holder easily releases from the table surface. This feature relates to vacuum adhesion of the holder on any type of smooth non-porous surface.

The hollowed circular aperture may be referred to as a circular recess. The terminology of the related elements may then be described, referring to FIG. 8, as the inner vertical recess wall 24 and the recess bottom 18.

In a method of using the holder of the present invention, the user first sets the container inside the corresponding aperture of the holder as shown in FIGS. 1-3. For holding a small container, the adapter ring is first placed within the aperture of the holder as shown in FIG. 4 and the container is placed within the adapter ring. The holder is then placed on a surface such as a table or floor. The user then applies a downward pressure sufficient to force the air from between the table or floor surface and the underside of the holder. Once released, the tendency of the holder to spring back to its natural position creates a vacuum force which allows the holder to resist sliding on the table or floor surface when a horizontal force is applied to the container. In the occasion wherein the table or floor surface is porous, the tackiness of the holder is sufficient to prevent sliding of the container even when no vacuum is created. The user then contacts the applicator to the paste wherein a quantity of paste adheres to the applicator and then applies the paste on the applicator to the item being cleaned or polished. Once the paste is rubbed into the item, the user may repeat the steps of contacting the applicator to the paste and applying the paste to the item.

For containers too large to fit within the adapter ring, the adapter ring is not placed within the aperture of the holder, and the container is placed directly within the corresponding aperture of the holder.

Thus, the present invention provides a holder for various sized containers of polish, waxes, pastes and liquids. The present invention also provides a holder for various sized containers of polish, waxes, pastes and liquids which will provide resistance to sliding on porous and non-porous surfaces. The present invention also provides a holder for various sized containers of polish, waxes, pastes and liquids which is versatile in the container configurations which are acceptable to the aperture of the holder.

The present invention provides a method for using a holder for various sized containers of polish, waxes, pastes and liquids used for metal, wood, and shoe maintenance.

The preferred embodiment of the present invention provides a holder for containers of polish, waxes, pastes and liquids which includes an adapter ring for securing various sized containers.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A holder for circular containers of polish, waxes, pastes and liquids comprising:

a generally circular base having an underside surface cupped downward and a hollowed circular aperture including an aperture bottom having a circular groove adapted to fit the bottom surface of a container having a ring protruding downward, the holder including at least one ridge for engaging a bottom portion of a container, an inner vertical aperture wall, at least one outer vertical wall concentrically spaced with the inner vertical aperture wall such that the holder frictionally accepts various sized containers, and a notch in a portion of the ridge for accommodating a key disposed on the vertical wall of a container, the notch extending into a portion of the inner vertical wall circumference; and an adapter ring having an outer diameter corresponding to the at least one vertical aperture wall, an inside diameter adapted to frictionally support the container, an inwardly protruding lip along a bottom portion of the inside diameter for supporting the bottom of the container and a downwardly protruding ring extending below the inwardly protruding lip and engagable with the circular groove on the aperture bottom;

wherein the holder is a flexible elastomeric material having a tackiness sufficient to prevent the holder from sliding across a support surface upon which the holder is placed.

2. The holder of claim 1 including at least one additional adapter ring interchangeable with the first adapter ring for frictionally supporting a container.

* * * * *